US005222902A

United States Patent [19]

Piersch

[11] Patent Number: 5,222,902

[45] Date of Patent: Jun. 29, 1993

[54] INTERLOCKING BLOCKS

[75] Inventor: Steven E. Piersch, Dubuque, Iowa

[73] Assignee: The ERTL Company, Dyersville, Iowa

[21] Appl. No.: 740,930

[22] Filed: Aug. 6, 1991

[51] Int. Cl.[5] ..... A63H 33/08

[52] U.S. Cl. ..... 446/121; 446/110; 446/111; 446/116; 403/345

[58] Field of Search ..... 446/110, 108, 111, 112, 446/113, 115, 116, 120, 121, 124, 128, 125, 444; 403/330, 345; 52/595, 593; 238/10 F, 10 E, 10 A

[56] References Cited

U.S. PATENT DOCUMENTS

| | | | |
|---|---|---|---|
| 1,061,637 | 5/1913 | Schwarz . | |
| 2,150,707 | 3/1939 | Anderson | 446/124 |
| 2,407,927 | 9/1946 | Hayden . | |
| 2,909,867 | 10/1959 | Hobson . | |
| 2,931,129 | 4/1960 | Boniface . | |
| 2,968,118 | 1/1961 | Paulson . | |
| 3,032,919 | 5/1962 | Amsler | 446/124 X |
| 3,380,188 | 4/1968 | Baudoux . | |
| 3,624,956 | 12/1971 | Dunn et al. | 446/111 |
| 3,667,153 | 6/1972 | Christiansen | 446/124 |
| 3,712,539 | 1/1973 | Staats | 238/10 E |
| 3,768,846 | 10/1973 | Hensley et al. | 446/120 X |
| 3,827,177 | 8/1974 | Wengel | 446/124 X |
| 3,872,620 | 3/1975 | Daenen | 446/112 |
| 3,890,738 | 6/1975 | Bassani | 446/111 |
| 3,900,985 | 8/1975 | Yoen | 446/124 |
| 3,902,291 | 9/1975 | Zucht . | |
| 4,058,909 | 11/1977 | Poleri | 446/111 X |
| 4,082,220 | 4/1978 | Cheng et al. | 238/10 F |
| 4,108,562 | 8/1978 | Collard et al. | 446/120 X |
| 4,193,221 | 3/1980 | Beck . | |
| 4,203,548 | 5/1980 | Cheng | 238/10 F |
| 4,270,302 | 6/1981 | Dandia | 446/112 X |
| 4,334,868 | 6/1982 | Levinrad | 446/112 X |
| 4,345,762 | 8/1982 | Lebelson | 446/116 X |
| 4,767,053 | 8/1988 | Cook et al. | 446/444 X |
| 4,941,610 | 7/1990 | Frauca | 238/10 A |

*Primary Examiner*—Mickey Yu

*Attorney, Agent, or Firm*—Marshall, O'Toole, Gerstein, Murray & Borun

[57] ABSTRACT

A toy connector in accordance with the present invention joins first and second structural elements which are aligned adjacent one another and engaged to form a flush, secure connection having a female connector assembly joined to the first structural element having at least two recess elements and at least one female snap element disposed between the recess elements, and a male connector assembly joined to the second structural element having at least one tongue adapted to engage each of the recess elements, and at least one male snap element adapted to engage the female snap element.

12 Claims, 3 Drawing Sheets

INTERLOCKING BLOCKS

BACKGROUND OF THE INVENTION

The present invention relates generally to toy blocks and more specifically to a toy block connector that forms a flush and secure yet releasable connection that conceals the coupling mechanism.

A number of toy blocks and construction sets have been developed that simulate structures such as skyscrapers, houses, and castles. Columns, beams, panels, and preformed building components such as roofs and walls are among the structural elements used to build the various toys. There are a variety of connectors that can be used to join each type of structural element to suit the particular needs and materials of the structural elements.

SUMMARY OF THE INVENTION

A connector in accordance with the present invention provides a novel alternative to the connectors previously developed. The connector comprises male and female connector assemblies. The female connector assemblies have alternating recesses and female snaps, and are joined to toy structural elements including, but not limited to, beams, columns, panels, bases, foundations and roofs. They are adapted to engage the male connector assemblies which have alternating tongues and male snaps and which are joined to another toy structural element. When assembled, the male and female connector assemblies form a secure flush connection between structural elements that conceals the male and female connecting assemblies when viewed from the outside of the adjoined structural elements. The connector is resilient enough for children to assemble and disassemble in a variety of configurations which enhances the play value of the toy.

In use, the tongues are adapted to align with and frictionally engage the female recesses. The male and female snaps are also adapted to align and snap engage one another. To make the connection, a first structural element having a female assembly is aligned adjacent to a second structural element having a male assembly so that the tongues of the male engage the recesses of the female and the female snaps engage the male snaps.

In one embodiment, the female connector assemblies are joined to, or essentially make up, couplings that engage one or more male connector assemblies which are in turn joined to the edges of panels. It is noted that male and female connector assemblies may be joined to any structural element of a toy construction set.

The female recesses may comprise a web and a flange both extending outwardly from the structural element and spaced apart from one another, defining the recess therebetween. The female snaps can be a resilient web extending outwardly from the structural element between the recesses. A lug may be formed on a distal portion of the web to engage the male snap. The web for both the recesses and the female snaps may be continuous, running the length of the structural element.

The male snaps may also be resilient and may be in the form of a tab extending outwardly from another structural element. The snap may further comprise a lug formed on a distal portion of the tab to engage a female snap.

When both the male and female snaps have lugs adapted to engage one another the connector operates by bringing the two structural elements together and inserting the tongues into the recesses causing them to frictionally engage. The lugs of the male and female snaps should be in the same plane so that when they engage they can only pass over one another due to the resilient deformation of the webs and tabs and the restraining force of the engagement of the tongues and recesses. Once the lugs have passed over one another the web and tab return to their original shapes. The connection is secure due to the frictional engagement between the tongues and recesses and the relative positions of the lugs.

One or more stops may be joined to the recesses which engage one or more tongues and restrain their lateral movement out of the recesses. A stop may join the recess web and flange to close one end of the recess thereby blocking a tongue inserted in the recess from moving laterally out of the recess.

One or more female connector assemblies may be joined to an edge or edges of a panel, coupling or other structural element so long as they are adapted to engage complimentary male connector assemblies on another panel, coupling or other structural element. A single structural element may have both male and female connector assemblies joined to it which are adapted to engage complimentary connector assemblies on other structural elements. It may be desirable to join structural elements shaped like various building components such as roofs or foundations using the connector of the present invention.

Other features and advantages are inherent in the connector claimed and disclosed or will become apparent to those skilled in the art from the following detailed description in conjunction with the accompanying diagrammatic drawings.

DETAILED DESCRIPTION OF THE INVENTION

Figure 1:
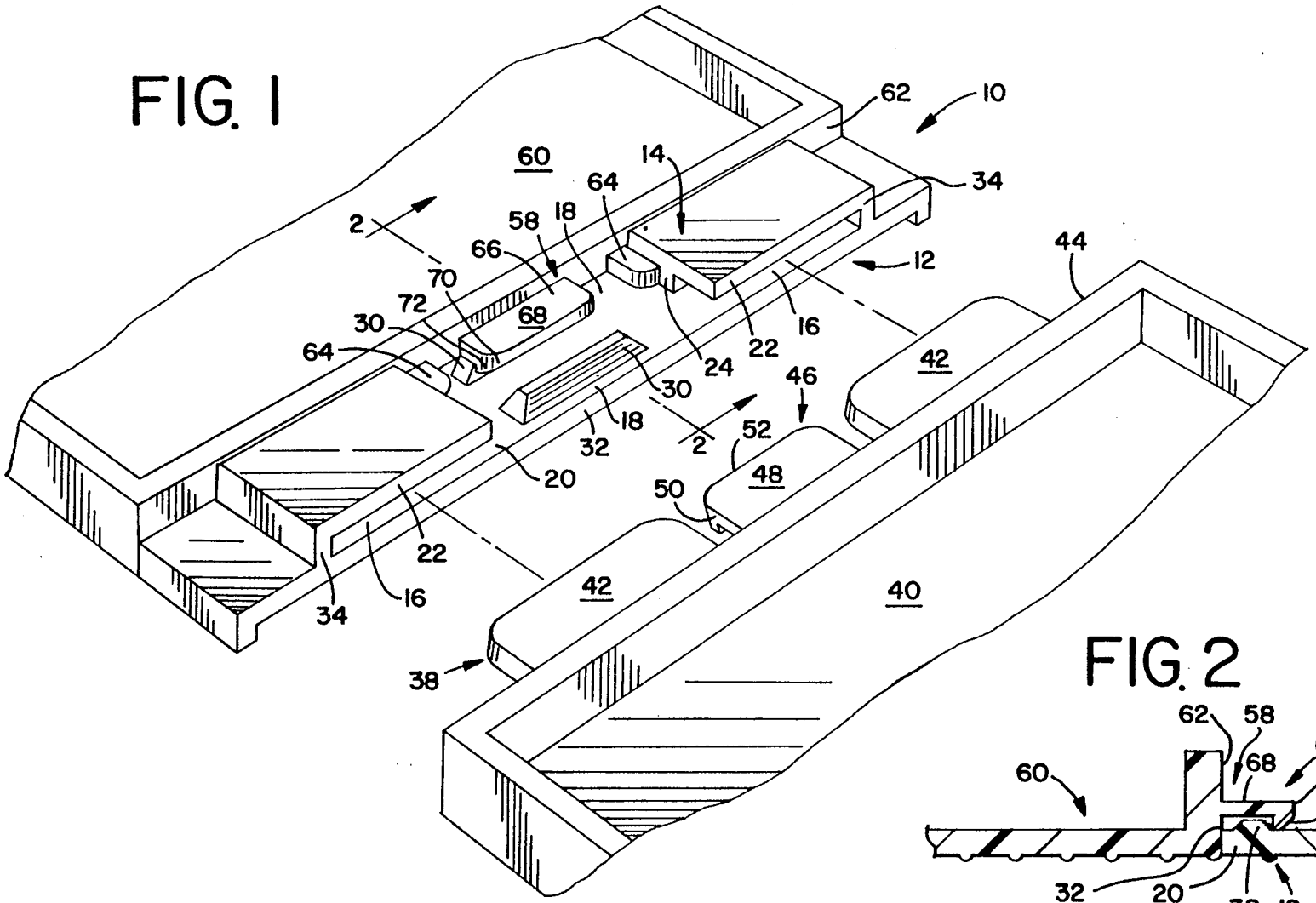
FIG. 1 is a perspective view of a coupling member having two contiguous female assemblies joined at their edges, one female connector assembly is engaging a male connector assembly joined to a panel while the other female assembly is unengaged but in alignment with another panel having a male connector assembly.

Referring to FIG. 1, indicated generally at 10 is a coupling comprising a first female connector assembly 12 contiguous with a second female connector assembly 14. Each female connector assembly has two recesses 16 and a female snap 18. In the illustrated embodiment, the recesses 16 and female snap 18 share a common web 20. Together with web 20, the recesses 16 each comprise a flange 22 parallel to and spaced apart from web 20. A partition 24 separates the recesses 16 of first female connector assembly 12 from the recesses 16 of second female connector assembly 14. The female snaps 18 each have an upwardly extending lug 30 joined to web 20 near a distal edge 32 of web 20. Finally, the recesses illustrated include stops means 34 which close one end of the recesses and restrain lateral movement of engaged tongues out of the recesses.

A panel 40 has joined to it a male connector assembly 38 complimentary to female assembly 12. Male assembly 38 has alternating tongues 42 joined to and extending outwardly from a panel edge 44. Tongues 42 are adapted to frictionally engage recesses 12. In between tongues 42 is a male snap 46 which is also joined to and extends outwardly from panel edge 44. Male snap 46 comprises a resilient tab 48 and a downwardly extending lug 50 joined near a distal edge 52 of tab 48. Male snap 46 is adapted to engage female snap 18.

In operation, coupling 10 and panel 40 are aligned and brought adjacent one another until tongues 42 frictionally engage female recesses 16 and female snap 18 and male snap 46 resiliently engage one another at their respective lugs 30 and 50 which are positioned in a predetermined plane, as illustrated, which is selected to ensure their contact. When the lugs engage, web 20 bends downwardly and tab 48 bends upwardly until the lugs pass one another and the web 20 and tab 48 snap back to their original shapes. A complete connection is illustrated in FIGS. 1 and 2 between female coupling 10 and a second panel 60 having a male assembly 58 joined thereto.

While web 20 and tab 48 are described as resilient, certain plastics or other materials may be used to form coupling 10 and panel 40 (or any other structural element) which permit the connector to operate by flexing coupling member 10 along substantially its entire length and panel 40 along its entire edge 44. The snap mechanism operates in substantially the same way as described above except that as lugs 30 and 50 pass over one another, coupling 10 and panel 40 are bowed along some, if not all, of their length but snap back to their original shape when the lugs completely pass one another.

Second panel 60 has joined to its edge 62 male connector assembly 58 having outwardly extending tongues 64 which are frictionally engaging recesses 16 of second female connector assembly 14. Between tongues 64 is a male snap 66 joined to and extending outwardly from edge 62 and which is illustrated as engaging female snap 18. Male snap 66 comprises a resilient tab 68 and a downwardly extending lug 70 joined to tab 68 near its distal edge 72.

Figure 2:
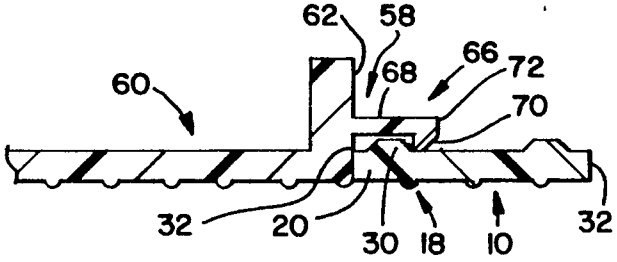
FIG. 2 is a cross sectional view taken along line 2—2 in FIG. 1.

FIG. 2 illustrates a sectional view of the complete panel connection between second female connector assembly 14 of coupling 10 and male connector assembly 58 taken along line 2—2 in FIG. 1. Female snap 18 is engaged with male snap element 66 extending outwardly from panel 60 edge 62. Male snap element 66 comprises tab 68 and downwardly extending lug 70 joined near the distal edge 72 of tab 68.

Figure 3:
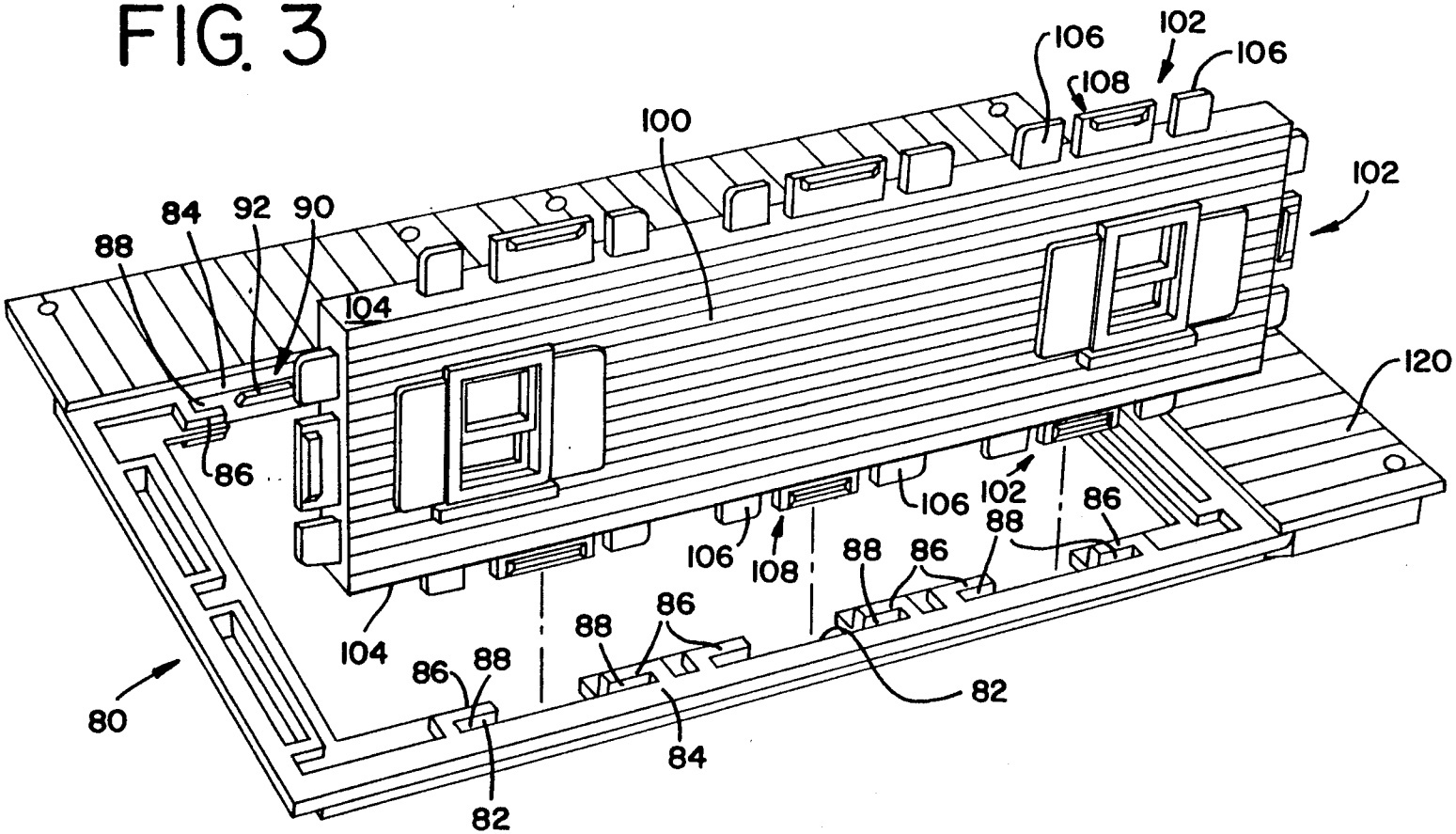
FIG. 3 is a perspective view of a panel in the shape of a toy house exterior wall having a plurality of male connector assemblies, and toy house foundation having formed in it a plurality of female connector assemblies.

FIG. 3 illustrates substantially similar male and female connector assemblies as those illustrated in FIGS. 1 and 2 except that the assemblies are joined to different toy structural elements. A house foundation 80 has formed in it a plurality of female connector assemblies 82. A continuous web 84 is used for all female assemblies 82 on one side of the foundation. A plurality of flanges 86 are shown which are formed in foundation 80, parallel to and spaced apart from web 84 to define a plurality of recesses 88. A plurality of female snaps 90 comprise web 84 and lugs 92.

A simulated wall panel 100 has a plurality of male connector assemblies 102 joined to its edges 104. Each male connector assembly 102 comprises two tongues 106 separated by a male snap 108. Tongues 106 are adapted to frictionally engage recesses 88. Male snaps 108 comprise resilient tabs 110 and lugs 112 adapted to engage female snaps 90 in the manner described above.

Also illustrated in FIG. 3 is a porch 120 formed together with foundation 80. When foundation 80 and wall panel 100 are snapped together, they simulate part of an actual frame house having a porch 120. Other building elements, not illustrated, include other wall panels, doors and at least one roof section. The completed toy structure may resemble a house.

Figure 5:
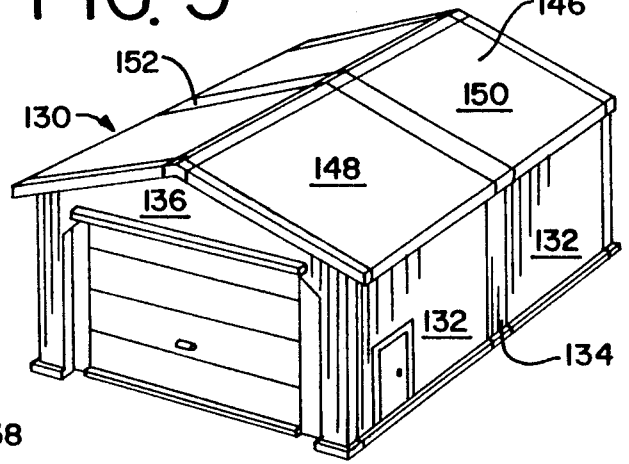
FIG. 5 is a perspective view of a completed toy structure constructed with the connector of the present invention.
Figure 4:
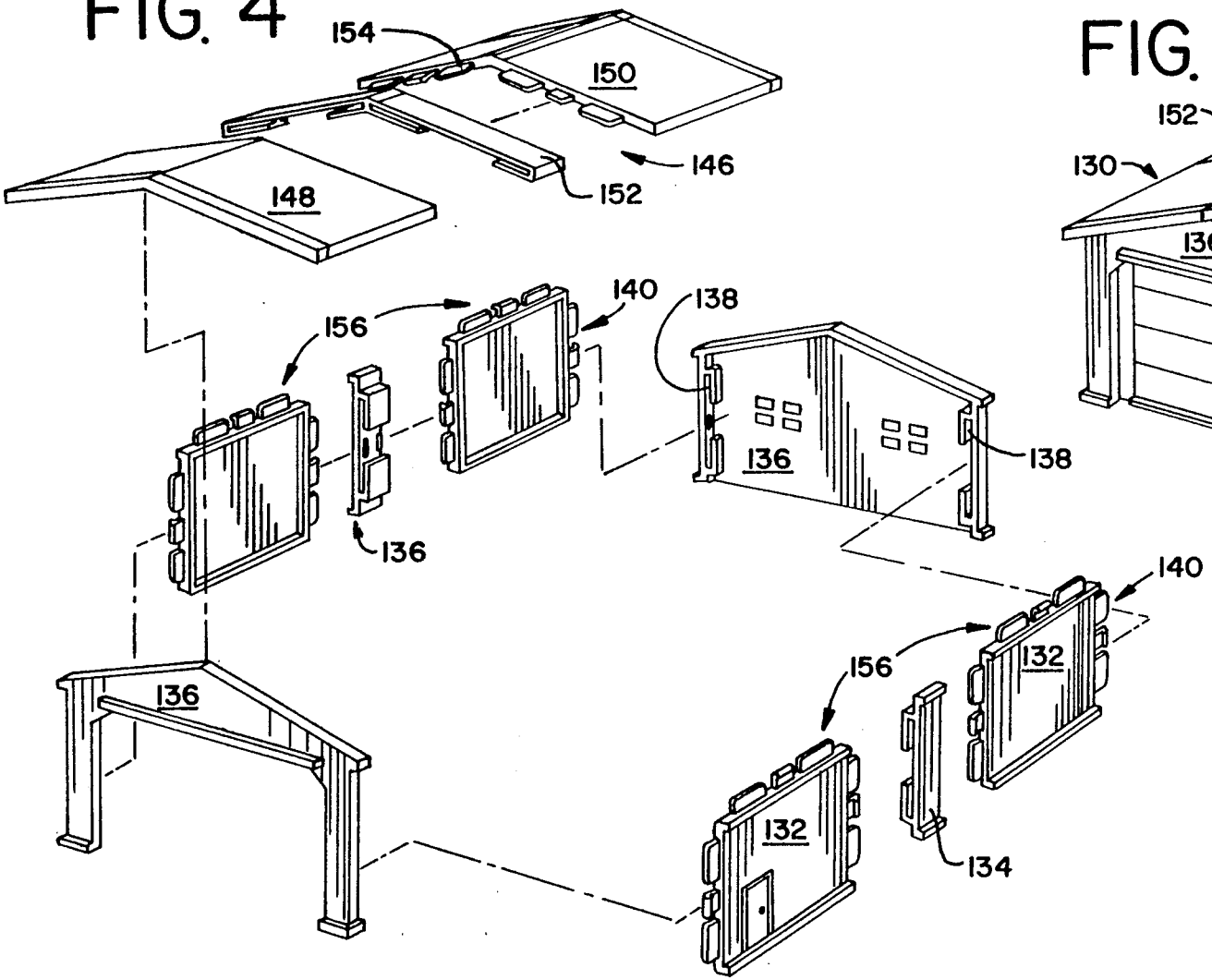
FIG. 4 is an exploded view of a toy building having panels and couplings themselves having a plurality of the male and female connector assemblies of the present invention.

FIG. 4 illustrates an exploded view of the garagetype structure 130 illustrated in FIG. 5. In this structure, garage 130 comprises a number of wall panels 132 joined together by couplings 134 comprising contiguous female connector assemblies. End walls 136 are fitted with female connector assemblies 138 which are adapted to engage male connector assemblies 140 joined to panels 132.

Roof structure 146 comprises two angled panels 148 and 150, respectively, joined by coupling 152. Roof panels 148 and 150 are fitted with male connector assemblies 154 (not visible on panel 148) which are adapted to engage contiguous female connector assemblies of coupling 152. Alternatively, roof panel 148 could be fitted with female connector assemblies adapted to engage male connector assemblies 154 fitted on roof panel 150, thereby obviating the need for coupling 152. (Embodiment not illustrated). Both roof panels 148 and 150 are fitted with female connector assemblies (not visible) which are adapted to engage male connector assemblies 156 joined to the tops of wall panels 132.

The foregoing detailed description has been given for clearness of understanding only, and no unnecessary limitations should be understood therefrom, as modifications will be obvious to those skilled in the art.

We claim:

1. A male and female connector for joining first and second structural elements which are aligned adjacent one another and engaged to form a flush, secure connection, comprising:

(a) a female connector assembly joined to said first structural element having, (i) at least two recess elements, and (ii) at least one female snap element disposed between said recess elements; and (b) a male connector assembly joined to said second structural element having, (i) at least one tongue adapted to engage each of said recess elements, and (ii) at least one male snap element adapted to engage said female snap element; and said recess elements and said female snap element comprise, a continuous web joined to and extending from said first structural element;

a plurality of flange elements joined to and extending from said structural element and substantially parallel to and spaced apart from said web to form said recesses; and a lug joined to a distal portion of said web between said recess element to define said female snap element, said lug adapted to engage said male snap elements.

2. The connector of claim 1 in which each of said male snap elements comprises:

(a) a resilient tab joined to and extending from said second structural element; and (b) a lug joined to the distal end of said tab, said lug being adapted to engage said female snap element.

3. The connector of claim 1 further comprising at least one stop means for restraining movement of said tongues.

4. The connector of claim 1 further comprising a stop means joining said web and said flange of each recess element for restraining movement of said tongues.

5. A male and female connector for joining first and second structural elements which are aligned adjacent one another and engaged to form a flush, secure connection, comprising:

(a) a female connector assembly joined to said first structural element having, (i) two recesses elements, and (ii) a female snap element disposed between said recess elements; and (b) a male connector assembly joined to said second structural element having, (i) at least one tongue adapted to engage each of said recess elements, and (ii) a male snap element adapted to engage said female snap element; and said recess elements and said female snap elements comprise:

a continuous web joined to and extending from said first structural element;

a first flange joined to and extending from said first structural element, substantially parallel to and spaced apart from said web to define a first recess;

a second flange joined to and extending from said first structural element, substantially parallel to and spaced apart from said web to define a second recess which is spaced apart from said first recess; and a lug joined to a distal portion of said continuous web between said first and second recesses to define said female snap element, said lug being adapted to engage said male snap elements.

6. The connector of claim 5 in which said male snap element comprises:

(a) a resilient tab joined to and extending from said second structural element; and (b) a lug joined to a distal portion of said tab, adapted to engage said female snap element.

7. The connector of claim 5 further comprising at least one stop means for restraining movement of said tongues.

8. The connector of claim 5 further comprising a stop means joining said web and said flange of each recess element for restraining movement of said tongues.

9. A toy construction set having a connector for joining a coupling member and a second structural element which are aligned adjacent one another and engaged to form a flush, secure connection comprising:

(a) a female connector assembly joined to said coupling member having, (i) at least two recess elements, and (ii) at least one female snap element disposed between said recess elements; and (b) a male connector assembly joined to said second structural element having, (i) at least one tongue adapted to engage each of said recess elements, and (ii) at least one male snap element adapted to engage said female snap element; and each of said recess elements and said female snap elements comprise:

a continuous web;

a first partition member depending from said continuous web;

a first flange joined to said first partition member so as to be substantially parallel with and spaced apart from said web to define a first recess with said web;

a second partition member depending from said continuous web and spaced apart from said first partition member;

a second flange joined to said second partition member so as to be substantially parallel with and spaced apart from said web to define a second recess with said web; and a first lug joined to said web between said first and second recesses, said lug adapted to engage said male snap element.

10. The toy construction set of claim 9 in which each of said male snap elements comprises:

(a) a resilient tab joined to and extending from said second structural element; and (b) a lug joined to a distal portion of said tab, adapted to engage said female snap element.

11. The toy construction set of claim 9 further comprising at least one stop means for restraining movement of said tongues.

12. The toy construction set of claim 9 further comprising a stop means joining said web and said flange of each recess element for restraining movement of said tongues.

* * * * *